US006206663B1

(12) United States Patent
Frenken

(10) Patent No.: US 6,206,663 B1
(45) Date of Patent: Mar. 27, 2001

(54) PISTON PUMP

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 09/269,093

(22) PCT Filed: Apr. 25, 1998

(86) PCT No.: PCT/EP98/02474

§ 371 Date: Mar. 18, 1999

§ 102(e) Date: Mar. 18, 1999

(87) PCT Pub. No.: WO99/04165

PCT Pub. Date: Jan. 28, 1999

(30) Foreign Application Priority Data

Jul. 19, 1997 (DE) ..... 197 31 054
Oct. 2, 1997 (DE) ..... 197 43 747

(51) Int. Cl.[7] ..... F04B 39/10; F04B 53/12
(52) U.S. Cl. ..... 417/549; 417/545; 417/262
(58) Field of Search ..... 417/549, 260, 417/262, 267, 545, 555.1

(56) References Cited

U.S. PATENT DOCUMENTS 2,510,150 * 6/1950 Stephans ..... 417/250
2,820,415 * 1/1958 Born ..... 417/287
2,938,465 * 5/1960 McFarland ..... 417/252
3,016,838 * 1/1962 Bessiere ..... 417/206
5,575,627 * 11/1996 Vairin et al. ..... 417/252

* cited by examiner

*Primary Examiner*—Teresa Walberg
*Assistant Examiner*—Thor Campbell
(74) *Attorney, Agent, or Firm*—Trexler, Bushnell, Giangiorgi, Blackstone & Marr, Ltd.

(57) ABSTRACT

The invention relates to a piston pump (1) for delivering a fluid at low pressure and at a higher pressure, a higher delivery volume being provided in one pumping cycle at low pressure than at a higher pressure, having a low-pressure delivery piston (4), which is moved inside a pump cylinder (2) and acts upon a pressure chamber (7) under prestress into its delivery end position, a high-pressure delivery piston (11), an inlet valve (9) and an outlet valve (9, 10), a fluid delivery path (5) furthermore being provided between the inlet valve (9) and the outlet valve (10), and the low-pressure delivery piston (4) being able to be moved back counter to its prestress into a delivery starting position, and proposes, to achieve effective delivery at low pressure and at a higher pressure with the simplest possible construction, that the fluid delivery path (5) passes through the low-pressure delivery piston (4), that a valve (6) is provided in the low-pressure delivery piston (4), which valve shuts in the case of movement into the delivery starting position, that the high-pressure delivery piston (11) and the low-pressure delivery piston (4) operate in a common pressure chamber (7), and that the high-pressure delivery piston (11) moves the low-pressure delivery piston (4) counter to its prestress.

14 Claims, 7 Drawing Sheets

PISTON PUMP

The invention relates to a piston pump for delivering a fluid at low pressure and at a higher pressure, a higher delivery volume being provided in one pumping cycle at low pressure than at a higher pressure, having a low-pressure delivery piston, which is moved inside a pump cylinder and acts upon a pressure chamber under prestress into its delivery end position, a high-pressure delivery piston, and an inlet valve and an outlet valve, a fluid delivery path furthermore being provided between the inlet valve and the outlet valve, and the low-pressure delivery piston being able to be moved back counter to its prestress into a delivery starting position.

Piston pumps of this type are used, for example, in manually operated or motor-driven hand tools. In this context, reference is made to prior art, for example, in accordance with U.S. Pat. Nos. 432,107, 5,195,354 and 2,688,231. This prior art relates to motor-driven hand tools for compressing cable terminals or cable connectors. Furthermore, however, the subject-matter of the invention is also important, for example, with regard to shears, for example cable shears. In this context, reference is made to the German Utility Model 94 16 535 and the German Patent Application 196 49 932 which is not a prior publication. Moreover, pumps of this type are also used in other areas of technology. Reference is made, for example, to U.S. Pat. Nos. 2,845,033 and 674,381.

Pumps which have two pressure stages are frequently used, primarily for the drive of hydraulic tools. Such pumps supply a far greater volume of oil up to a certain limit pressure, which may be 5% of the maximum pressure, than at maximum pressure. The operating speed of hydraulic devices can thus be increased substantially because, in many tools, such as for example compression tools for the compression of cable terminals, a certain idle stroke must first be travelled before the workpiece is contacted and the actual operation takes place with a high power requirement. During the idle stroke, only the force of the piston restoring spring of the hydraulic cylinder of the tool generally has to be bridged. A low oil pressure is sufficient for this purpose.

Many different construction types of two-stage pumps are known. It is possible, for example, to combine two different pump construction types with one another and drive them at the same time, that is to say, for example, a gear pump for the low pressure range and a piston pump for the high pressure range. As soon as the required starting pressure exceeds the operating pressure of the low-pressure pump, its delivery flow is fed back into the tank via a pressure relief valve.

Two-stage piston pumps are particularly common for manually actuated hydraulic tools, where partial piston pumps are used both for the low pressure and for the high pressure. A widespread construction is one in which both pistons are combined in the form of a pump plunger with two different diameters. The hydraulically active surface in the low-pressure part is the annular surface between the two diameters and, in the high-pressure piston, it is the entire cross-sectional area of the small diameter. Both the low-pressure and the high-pressure pump each have an inlet valve connected to the tank and an outlet valve connected to the delivery side. A pressure relief valve is required additionally for the low-pressure stage, by means of which valve the oil flows back into the tank when the pressure of the low-pressure stage has been exceeded.

U.S. Pat. No. 4,492,106 relates to a lever-actuated hand tool in a configuration for the compression of cable terminals. Proposed in this case is a pumping device which has a high-pressure delivery piston and a low-pressure delivery piston. The low-pressure delivery piston comprises a spring-mounted pipe section with a pipe bottom which forms the piston head. The low-pressure delivery piston is displaced counter to the spring force by a continuation of the high-pressure delivery piston, hydraulic liquid being sucked in from a supply container. The projection of the high-pressure delivery piston then moves back and, on account of the spring acting upon it, the low-pressure delivery piston delivers the sucked-in hydraulic liquid into the working space. The delivery stops as soon as the pressure in the delivery chamber can no longer be overcome by the spring force. In the known pump, then only the high-pressure piston continues to operate.

Setting out from the above mentioned prior art, the invention deals with the technical problem of specifying a piston pump for delivering a fluid at low pressure and at a higher pressure, which permits effective delivery with a construction which is as simple as possible.

This technical problem is solved initially and substantially in the subject-matter of Claim 1, the solution being based on the fact that the fluid delivery path passes through the low-pressure delivery piston, that a valve is provided in the low-pressure delivery piston, which valve shuts in the case of movement in the delivery direction, and that the high-pressure delivery piston operates in the pressure chamber of the low-pressure delivery piston. There is only one common pressure chamber for the low-pressure delivery piston and for the high-pressure delivery piston. The low-pressure delivery piston is inevitably pushed back, namely by the high-pressure delivery piston. According to the invention, a simplified design of the piston pump is firstly achieved by the fact that the low-pressure delivery piston and the high-pressure delivery piston operate on the same pressure chamber. There is only one pressure chamber or pump chamber. The losses due to throttling operations are minimized or are no longer present. Furthermore, the fluid delivery path passes through the low-pressure delivery piston with a valve which shuts when the low-pressure delivery piston moves in the delivery direction. This also means that fluid flows into the pressure chamber when the low-pressure delivery piston moves counter to the delivery direction, the pressure in the pressure chamber not being higher than in the inflow direction ahead of the low-pressure delivery piston. On the contrary, the prevailing pressure is generally the same as in the inflow direction ahead of the low-pressure delivery piston, reduced by the force of a spring acting on the low-pressure delivery piston. When the valve in the low-pressure delivery piston is open, the pressure is virtually the same on both sides of the low-pressure delivery piston. The embodiment advantageously has few individual parts. Apart from the inlet valve and the outlet valve, only the valve in the low-pressure delivery piston is still required. Moreover, the constructional shape is simpler. There is only one pressure chamber, both for the low-pressure stage and the high-pressure stage. Furthermore, provision is made for the movement of the low-pressure delivery piston to take place counter to its prestress by the high-pressure delivery piston. The high-pressure delivery piston can act, in particular, directly on the surface of the low-pressure delivery piston. The high-pressure delivery piston preferably has, with regard to the pump, a smaller active cross-sectional area than the low-pressure delivery piston. The ratio may be, for example, 4:1 with regard to the area of the low-pressure delivery piston relative to the area of the high-pressure delivery piston. Good values are also achieved in practice with ratios of 6 to 7:1. In a further preferred embodiment, provision is also made for the high-pressure delivery piston to actuate the valve which is provided in the low-pressure delivery piston and shuts when the low-pressure delivery piston moves in the delivery direction. Owing to the fact that the high-pressure delivery piston does not have to bear against the low-pressure delivery piston when the low-pressure delivery piston moves in the delivery direction, in continuation of this concept, a valve which is very simple in construction, namely a plate valve, may-be provided in the low-pressure delivery piston. The valve in the low-pressure delivery piston furthermore preferably has a stem-like projection or an actuating end which passes through-the piston head of the low-pressure delivery piston. By means of this actuating end, actuation of the valve can take place by means of the high-pressure delivery piston in the manner described. The prestress of the low-pressure delivery piston into its delivery end position is advantageously achieved by means of a spring, furthermore preferably by means of a helical spring (compression spring). With regard to the valve contained in the low-pressure delivery piston, provision may also be made, in particular, for the spring which acts on the low-pressure delivery piston to prestress the valve into the closure position. Another preferred option is that the fluid volume in the piston pump, i.e. on the inlet side of the low-pressure delivery piston and in the pressure chamber, is as low as possible. In a variant, provision is made for this by the fact that the low-pressure delivery piston has a stem-like projection on the back to reduce the fluid volume between the inlet valve and the low-pressure delivery piston. In the same manner, a projection on the rear wall in the cylinder which receives the low-pressure delivery piston may also be provided, for example, or a combination of these measures. In a further variant, to achieve a high level of easy maintenance, provision is also made for the pump cylinder to have a base which can be opened in service. Owing to the fact that the pump cylinder base can be opened in service, it is possible, for example, in a simple manner to exchange or service the spring and/or the low-pressure delivery piston with the valve provided therein. For this purpose, the pump cylinder base may, in further detail, be secured by a screw connection in the pump housing. For this purpose, it is also recommended that the pump cylinder base is configured, as a whole, in a cup-like manner with a screwing-in thread on an outer wall of the cup edge. In combination or as an alternative thereto, it is also possible for the guide of the high-pressure delivery piston and, if appropriate, a part of the adjoining piston head to be screwed in this manner and to be exchangeable.

Furthermore, the invention is explained below with reference to the attached drawing which, however, illustrates only one exemplary embodiment.

Figure 1:
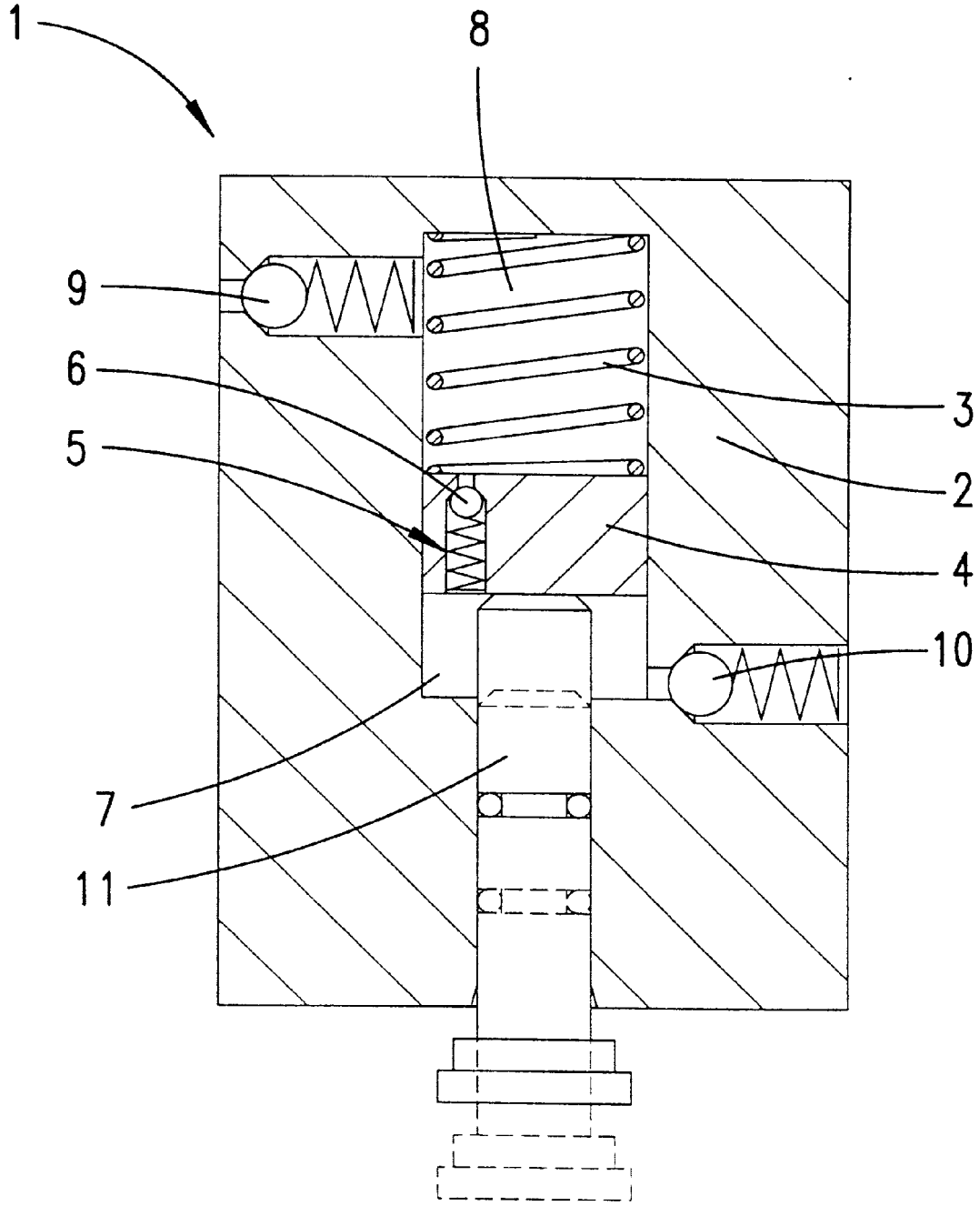
FIG. 1 shows a diagrammatic cross-sectional view of a piston pump;.

Initially with reference to FIG. 1, a piston pump 1 for delivering a fluid at low pressure and at a higher pressure is illustrated and described. The piston pump 1 may be used in very many different ways. With simple, manually actuated pumps, the high-pressure delivery piston can be actuated by a hand lever and, with the motor-driven manual devices already mentioned above, by a motor, such as an electric motor. The essential factor is that firstly, without load, a rapid operation is required, corresponding to a high delivery volume per stroke, and then higher pressures have to be applied under loading (with a lower delivery volume per stroke).

The piston pump 1 has a pump cylinder 2 in which a low-pressure delivery piston 4 can be moved counter to the prestress exerted by a spring 3. The low-pressure delivery piston 4 furthermore has a passage path 5 for the hydraulic fluid which is being pumped here. The fluid passage path 5 is closed by a valve 6 configured as a non-return valve. The valve 6 shuts when the low-pressure delivery piston 4 moves in the delivery direction, and can open when the low-pressure delivery piston 4 moves counter to it & delivery direction.

The low-pressure delivery piston 4 operates on a pressure chamber 7. The valve 6 correspondingly opens only when the pressure in the pressure chamber 7 is lower than on the inlet side in an inflow chamber 8 of the low-pressure delivery piston 4.

Figure 5:
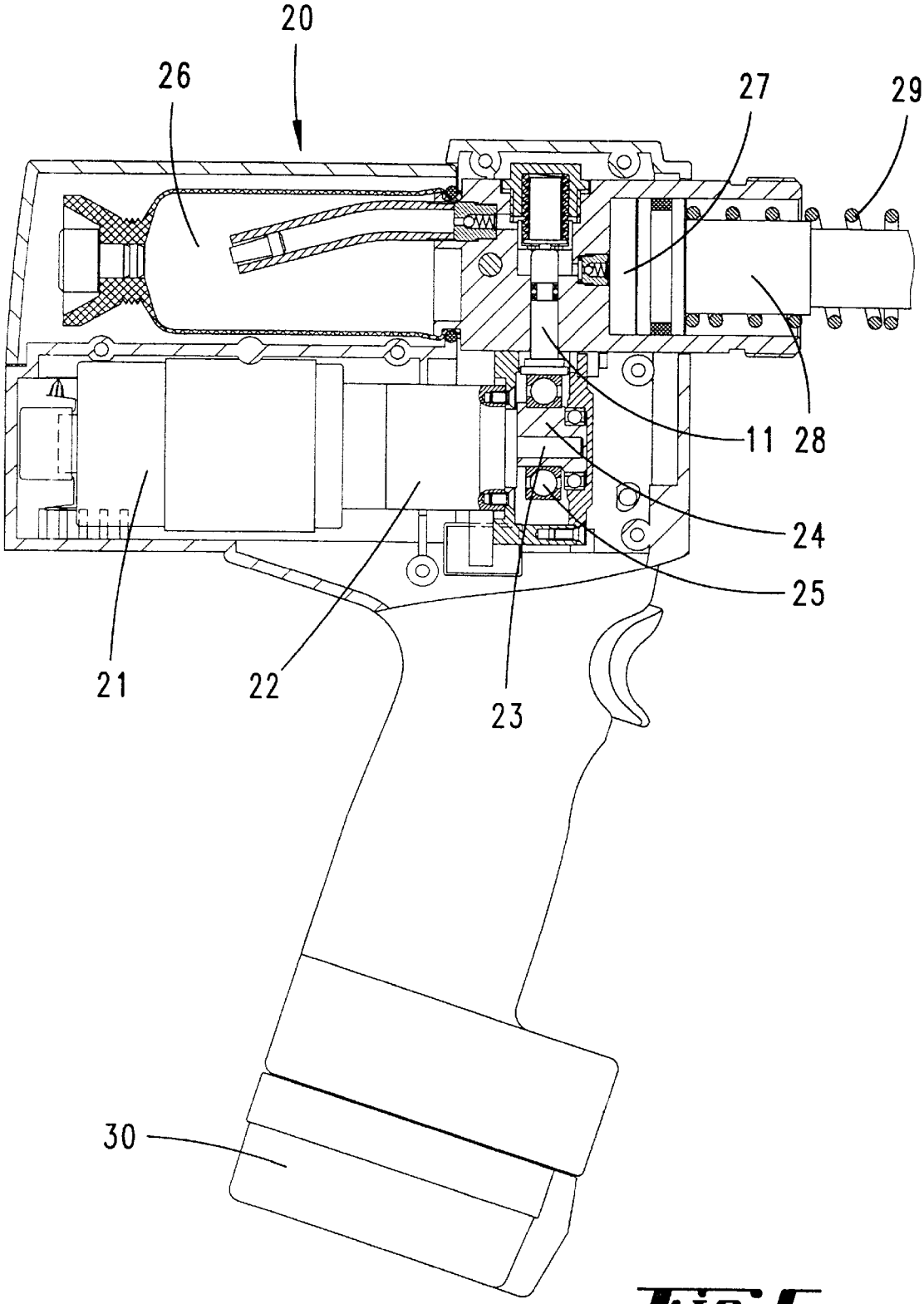
FIG. 5 shows a diagrammatic cross-sectional view of a motor-driven hand-held device with a piston pump according to FIG. 4.

Furthermore, the piston pump 1 has an inlet valve 9 and an outlet valve 10. The inlet valve 9 is arranged in a line connection to a fluid supply chamber. The outlet valve 10 is arranged in a line connection to a working space not illustrated in FIG. 1 (cf. also fluid supply chamber 26 and working space 27 in FIG. 5).

Also operating in the pressure chamber 7 is a high-pressure delivery piston 11 which can basically be driven in different ways which are not illustrated in detail in FIG. 1; for example, by means of an eccentric drive connected to an electric motor, by means of a manual drive, or another kind of drive which generates reciprocating motion. The range of movement of the high-pressure delivery piston 11 is indicated by the dashed illustration.

The high-pressure delivery piston 11 has a smaller active cross-section than the low-pressure delivery piston 4. The ratio here is about 4:1 (low-pressure delivery piston to high-pressure delivery piston).

Figure 2C:
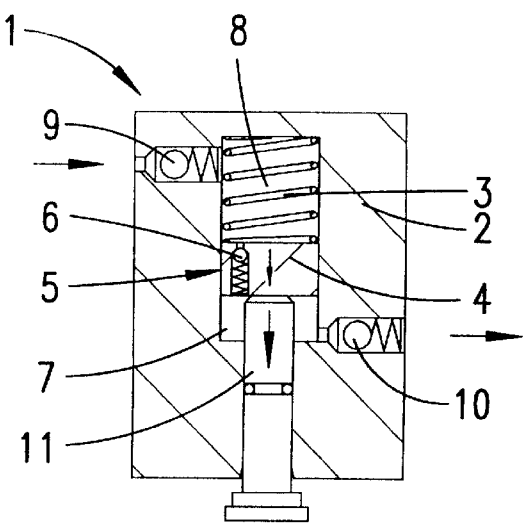
FIG. 2 shows, in the illustration a, b and c, the sequence of a delivery cycle at low pressure.

The functioning of the piston pump 1 is explained in greater detail with reference to FIGS. 2 and 3. FIG. 2*a* illustrates the delivery end position of the low-pressure delivery piston 4 in low-pressure operation, i.e. at low pressure in the working space. The spring 3 still exerts a prestress which, in the exemplary embodiment, for example, corresponds to a value of 10 bar. The high-pressure delivery piston 11 is in its position which is retracted to the furthest extent; in the exemplary embodiment, it terminates at the end face approximately flush with a (lower) cylinder wall 12 (of the pressure chamber 7).

Figure 2B:
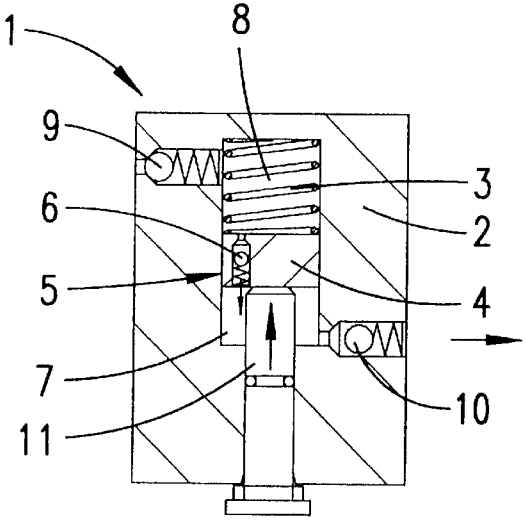
Figure 2A:
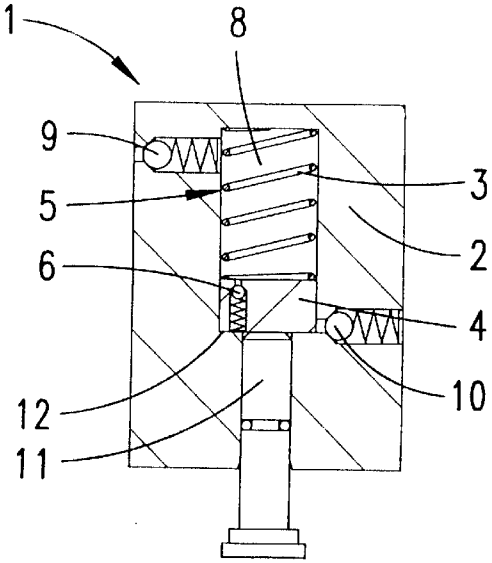

FIG. 2*b* illustrates the fact that the high-pressure delivery piston 11 is in—end face—contact with the low-pressure delivery piston 4 and is moving the latter back counter to the effect of the helical spring 3. While it is moving back, the valve 6 is open. Fluid is flowing from the inflow chamber 8, at the back in relation to the low-pressure delivery piston 4, through the fluid delivery path 5 into the pressure chamber 7. Since the volume of the pump (inflow chamber 8 and pressure chamber 7) is constantly being reduced at the same time by the retracting high-pressure delivery piston 11, the outlet valve 10 is also open and fluid is flowing into the working space.

FIG. 2*c* illustrates the delivery stroke of the low-pressure delivery piston 4. On account of the effect of the helical spring 3, the low-pressure delivery piston 4 moves in the direction of its delivery end position according to FIG. 2*a* after the high-pressure delivery piston 11 has begun its retraction movement. In this case, the valve 6 is closed and, on the inflow side, fluid is sucked into the inflow chamber from the supply container via the opening inlet valve 9 on account of the resulting vacuum. At the same time, fluid is displaced from the pressure chamber 7 via the open outlet valve 10 in the working space. It can be seen that the volume of fluid displaced in the process is dependent on the cross-sectional ratio of the low-pressure delivery piston 4 to the high-pressure delivery piston 11. The greater the—effective—cross-sectional ratio of the two pistons is, the more fluid is delivered into the working space via the outlet valve 10 in the low-pressure stage.

Figure 3C:
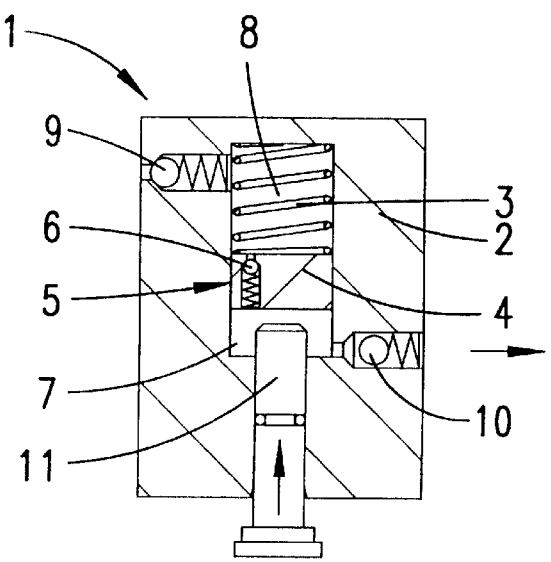
FIG. 3 shows, in the illustration a, b and c, the sequence of a delivery cycle at high pressure.
Figure 3B:
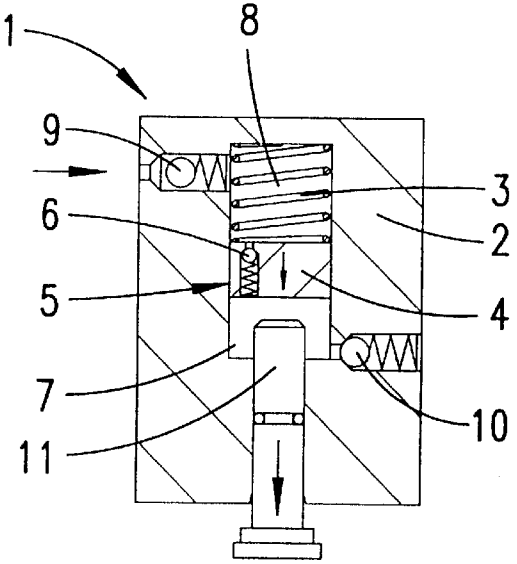
Figure 3A:
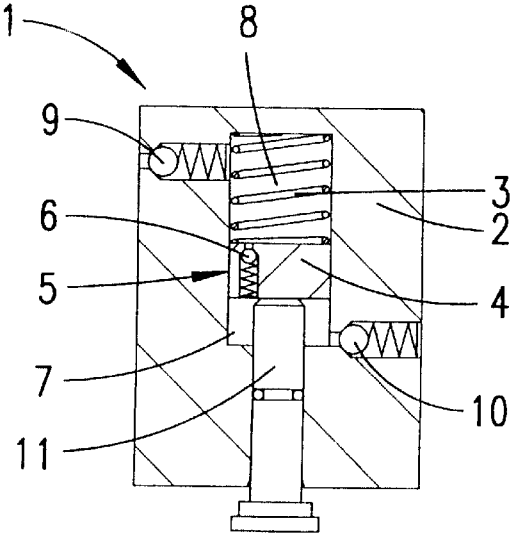

Referring to FIGS. 3*a* to 3*c*, a corresponding delivery cycle is illustrated, in which it is assumed that the pressure in the working space is higher than the prestress of the low-pressure delivery piston 4 in its delivery end position. The pressure should be substantially higher than the pressure of about 10 bar as first mentioned. The deciding factor is that the pressure in the working space is higher than that due to the helical spring (compression spring 3) in the upper position of maximum prestress of the low-pressure delivery piston 4.

FIG. 3*a* illustrates the delivery end position of the high-pressure piston 11. The high-pressure delivery piston 11 is retracted into the pressure chamber 7 to its maximum extent.

FIG. 3*b* illustrates a condition in which the high-pressure delivery piston 11 is on the path of its return stroke. The outlet valve 10 is closed, because the pressure in the pressure chamber 7 is now only determined by the spring 3. This may be, for example, a pressure of between 10 and 20 bar. This pressure is thus substantially lower than the pressure to be assumed as high in this state in the working space. The reducing pressure or the compensation of the volume enlargement resulting due to the extending high-pressure delivery piston 11 leads to a trailing movement of the low-pressure delivery piston 4. As a result and at the same time, fluid is sucked into the inflow 8 from the supply container through the opening inlet valve 9. During the process, the low-pressure delivery piston 4 does not reach the delivery end position according to FIG. 2*a*, but a position which is ahead of it in the delivery direction until compensation of the volume proportion of the extending part of the high-pressure delivery piston 11 has been reached.

FIG. 3*c* illustrates a point in time during the delivery stroke of the high-pressure delivery piston 11. The high-pressure delivery piston 11 is not (yet) in contact with the low-pressure delivery piston 4. As a result of the nevertheless prevailing pressure increase, the inlet valve 9 is closed. In contrast, the outlet valve 10 is open, since the pressure in the pressure chamber 7 has increased on account of the retracted high-pressure delivery piston 11 to the extent that it exceeds the pressure in the working space.

A further embodiment of the piston pump 1 is illustrated with reference to FIG. 4. The position represented corresponds to that of FIG. 3*a*, although this position here can relate both to a low-pressure and to a high-pressure cycle.

The inlet valve 9, the outlet valve 10 and the high-pressure delivery piston 11 are essentially unchanged.

Here, however, the low-pressure delivery piston 4 has a stem-like projection 13 at the rear end, this being the case at least in terms of function.

In fact, the stem-like projection 13 is provided on a plate 14 which is part of the valve 6 in this case. The valve 6, or in the specific embodiment the plate 14, furthermore has an actuating projection 15 on its front side.

The stem-like projection 13 results in a minimum fluid volume in the inflow chamber 8. This is required in order to achieve specific flow speeds there; moreover also, in order to achieve the least possible deflection on account of resilience due to the hydraulic liquid during the (high-pressure) delivery stroke. In general, however, the essential factor is that a fluid is used for the pump, which fluid is essentially incompressible.

Customary—oil-like—hydraulic liquids are appropriate here.

Figure 4:
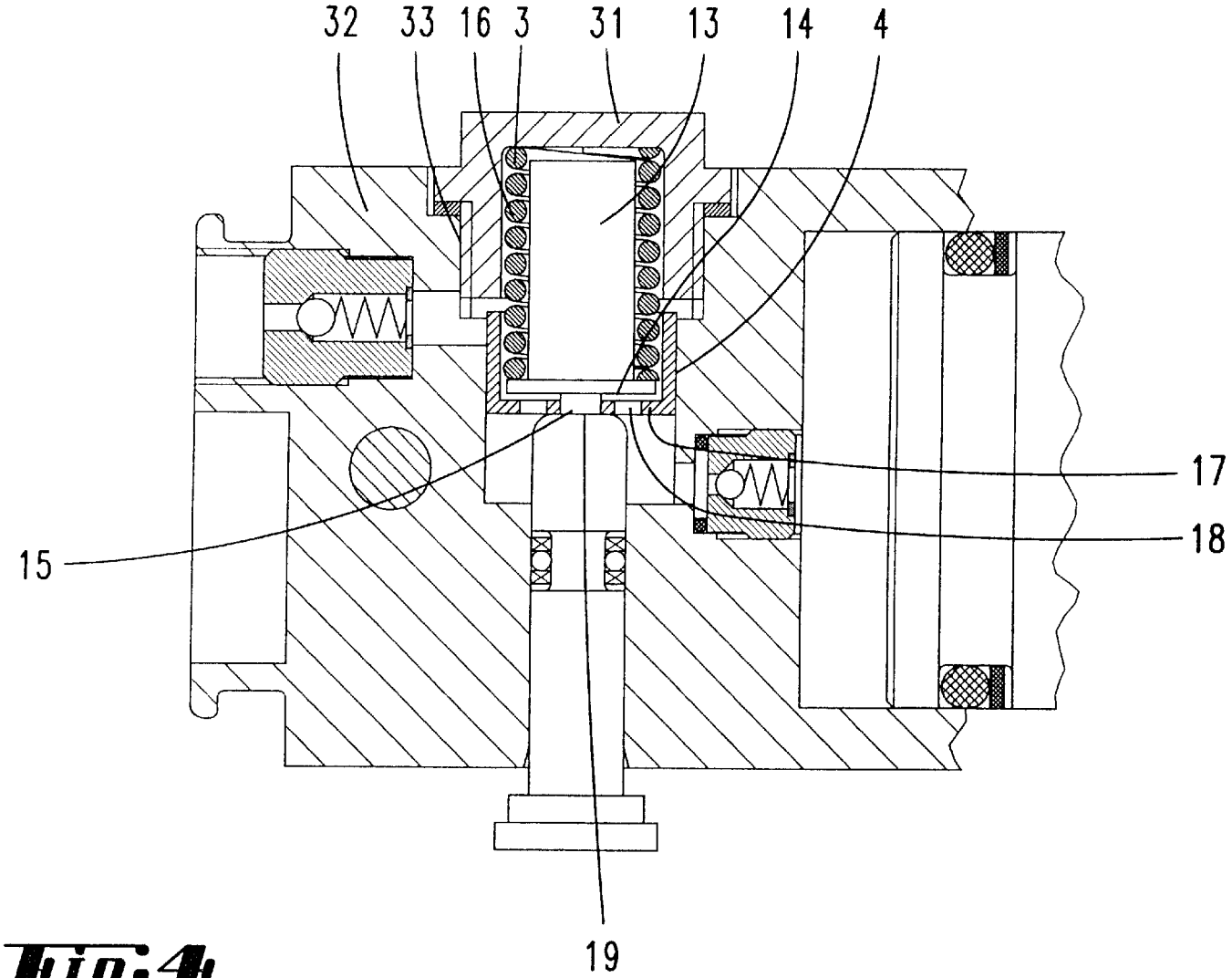
FIG. 4 shows the diagrammatic front view of a piston pump of a second embodiment.

In a further detail, the helical spring 3 is arranged, in the embodiment of FIG. 4, surrounding the cylinder-like projection 13.

Provided in the piston head 17 of the low-pressure delivery piston 4 are throughflow openings 18 which, in this embodiment, form the fluid delivery path 5. As can be seem, opening of the valve 6 is achieved by surface contact between an end face 19 of the high-pressure delivery piston 11 and the actuating projection 15 of the valve 6, so that fluid flows into the pressure chamber 11 from the inflow chamber 8 through the openings 18 in the piston head 17 of the low-pressure delivery piston 4. The valve 6 of the embodiment according to FIG. 4 is thus not pressure-actuated, but under enforced control.

In a further detail, it is a significant factor that, in the embodiment of FIG. 4, the piston head 31 is configured as a screw-in part. On the side wall, it has an external thread 33 which interacts with a corresponding internal thread on the pump housing 32. This permits simple exchange and provides ease of maintenance.

Figure 6:
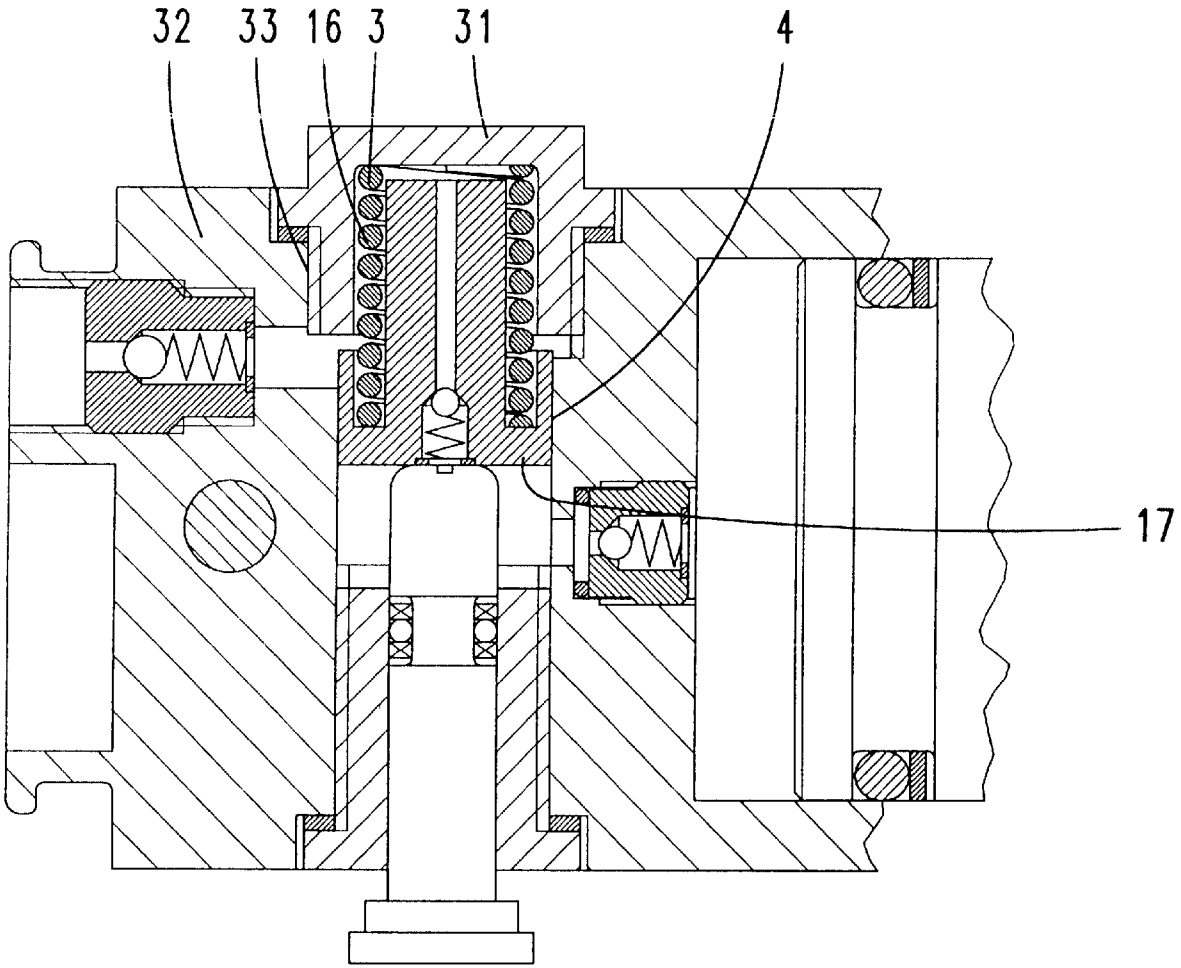
FIG. 6 shows an embodiment which is modified compared to FIG. 4.

The fact that both the piston guide for the high-pressure delivery piston 11 and the piston head for the low-pressure delivery piston 4 are configured for screwing in is illustrated in the embodiment of FIG. 6. It is preferable for only the piston guide for the high-pressure delivery piston 11 to be configured to be screwed in.

It is furthermore a significant factor that, in this embodiment, a throughflow path is formed in the low-pressure delivery piston 4, namely the cylinder-like projection. It is thus possible, on the one hand, to continue to keep the volume still provided in the compressed position of the spring 3 as small as possible but, on the other hand, in particular also to form such a flow path that relatively high flow speeds are always assured. It is also essential that the design is configured in such a way that there are few or no dead spaces.

A manually operated motor-powered tool with a piston pump according to the embodiment of FIG. 4 explained above is illustrated with reference to FIG. 5.

Arranged in the manually operated motor-powered tool 20 is an electric motor 21 which has a reducing gear 22. The reducing gear 22 acts via a shaft 23 on an eccentric 24 which, in turn, acts via a rolling bearing 25 on the high-pressure delivery piston 11.

In the manner explained above, for this purpose fluid is pumped into the working space 27 from the fluid supply chamber 26 and, as a result, an operating piston 28 is moved into its operating end position counter to the effect of a restoring spring 29. The return movement of the operating piston 28 takes place via the restoring spring 29 if—which is not illustrated in detail here—a drainage valve in the working space 27 is open, via which the fluid can then flow back into the supply chamber 26. The drive of the electric motor 21 is effected in further detail by means of a battery or an accumulator 30.

Figure 7:
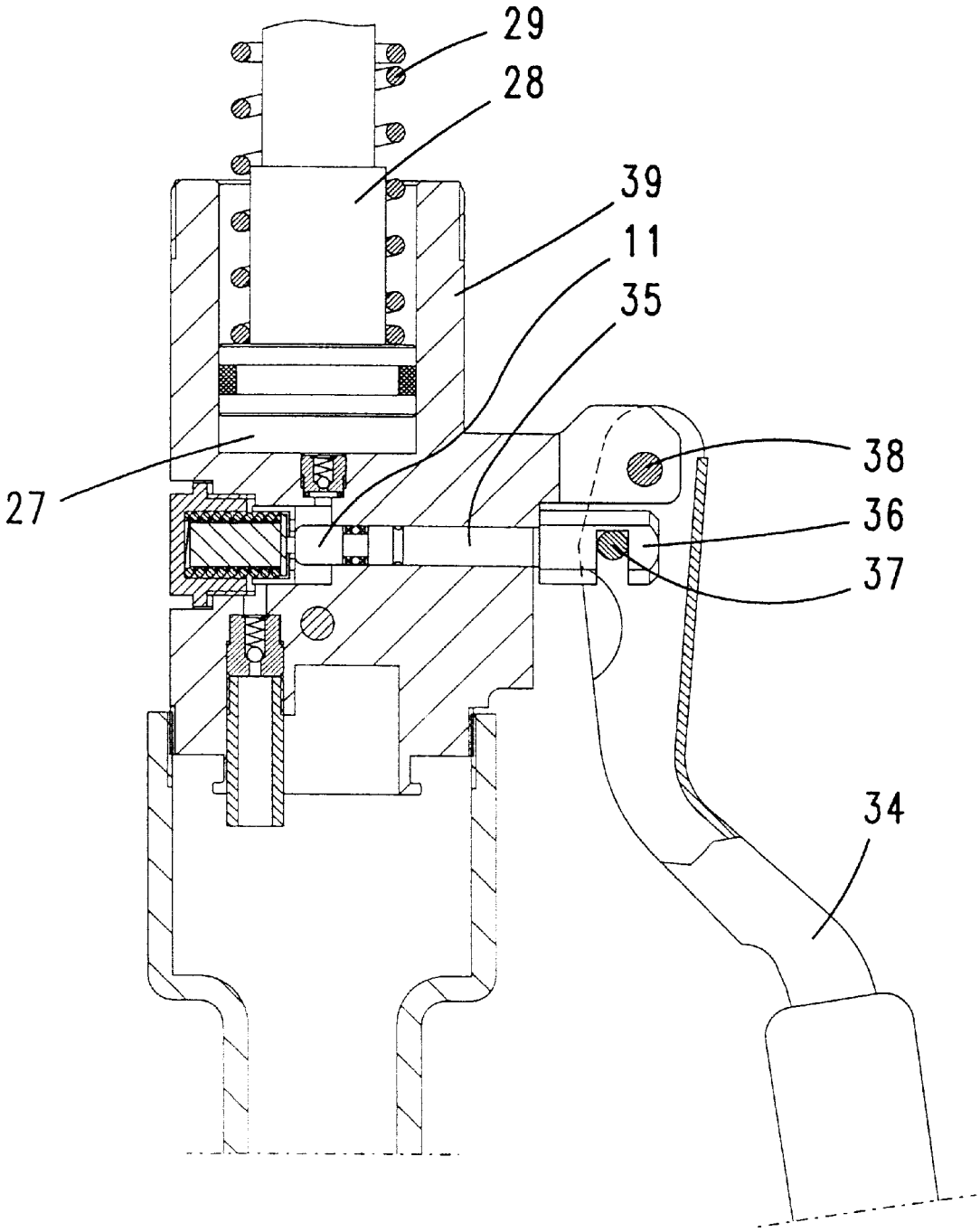
FIG. 7 shows a further embodiment in which the actuation takes place by means of a hand lever.

In the embodiment of FIG. 7, the high-pressure delivery piston 11 is actuated directly by means of a hand lever 34. For this purpose, the high-pressure piston 11 is connected specifically to a coaxially aligned connection piece 35 which is coupled by means of a hook shape 36 to a carrier pin 37 of the hand lever 34. The hand lever is mounted on the housing 39 by means of a rotary pin 38 which is independent thereof.

Otherwise the piston pump 1 in the embodiment of FIG. 7 behaves in the same manner as the piston pump 1 of the embodiments described above, reference thus being made thereto.

All the features disclosed are essential to the invention. In the disclosure of the application, the disclosure content of the associated/attached priority documents (copy of the preliminary application) is hereby also included to its full extent, also for the purpose of including features of these documents in claims of the present application.

What is claimed is:

1. A piston pump for delivering a fluid at low pressure and at a higher pressure, a higher delivery volume being provided in one pumping cycle at low pressure than at a high pressure, said piston pump comprising:

a low-pressure delivery piston, which is moved inside a pump cylinder and acts upon a pressure chamber under prestress into a delivery end position;

a high-pressure delivery piston;

an inlet valve and an outlet valve;

a fluid delivery path provided between the inlet valve and the outlet valve; and the low-pressure delivery piston being able to be moved back counter to its prestress into a delivery starting position, characterized in that the fluid delivery path passes through the low-pressure delivery piston, that a valve is provided in the low-pressure delivery piston, which valve shuts in the case of movement into the delivery starting position, in that the high-pressure delivery piston and the low-pressure delivery piston operate in a common pressure chamber, and in that the high-pressure delivery piston moves the low-pressure delivery piston counter to its prestress.

2. A piston pump according to claim 1, wherein the high pressure delivery piston has a smaller cross-section than a cross-section of the low pressure delivery piston.

3. A piston pump according to claim 1, wherein the high-pressure delivery piston moves the low-pressure delivery piston counter to its prestress.

4. A piston pump according to claim 1, wherein the valve is a pressure-actuated non-return valve.

5. A piston pump according to claim 1, wherein the valve is a controlled valve.

6. A piston pump according to claim 1, wherein the high-pressure delivery piston actuates the valve.

7. A piston pump according to claim 1, wherein the valve is configured as a plate valve.

8. A piston pump according to claim 1, wherein the valve has an actuating end which passes through a piston head of the low-pressure delivery piston.

9. A piston pump according to claim 1, wherein the prestress is achieved by means of a spring.

10. A piston pump according to claim 1, wherein the spring prestresses the valve into a closure position.

11. A piston pump according to claim 1, wherein the low-pressure delivery piston has a stem-like projection at the rear end to reduce the fluid flow path between the inlet valve and the low-pressure delivery piston.

12. A piston pump according to claim 1, wherein the pump cylinder has a pump cylinder base which can be opened in service.

13. A piston pump according to claim 12, wherein the pump cylinder base is secured by a screw connection in a pump housing.

14. A piston pump according to claim 12, wherein the pump cylinder base is configured in a cup-like manner with a screwing-in thread on an outer wall of the cup edge.

* * * * *